US011377821B2

(12) United States Patent
Lim et al.

(10) Patent No.: US 11,377,821 B2
(45) Date of Patent: Jul. 5, 2022

(54) CONSTRUCTION MACHINE SAFETY APPARATUS AND CONTROLLING METHOD

(71) Applicant: Doosan Infracore Co., Ltd., Incheon (KR)

(72) Inventors: Young Sup Lim, Suwon-si (KR); Duck Woo Park, Incheon (KR); Jun Hong Park, Goyang-si (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 521 days.

(21) Appl. No.: 16/485,185

(22) PCT Filed: Feb. 12, 2018

(86) PCT No.: PCT/KR2018/001843
§ 371 (c)(1),
(2) Date: Aug. 12, 2019

(87) PCT Pub. No.: WO2018/147704
PCT Pub. Date: Aug. 16, 2018

(65) Prior Publication Data

US 2019/0368163 A1 Dec. 5, 2019

(30) Foreign Application Priority Data

Feb. 10, 2017 (KR) ..... 10-2017-0018820

(51) Int. Cl.
*E02F 9/20* (2006.01)
*E02F 9/22* (2006.01)
(Continued)

(52) U.S. Cl.
CPC ..... *E02F 9/2058* (2013.01); *E02F 9/226* (2013.01); *E02F 9/2285* (2013.01); *E02F 9/24* (2013.01); *F02N 11/08* (2013.01); *F02N 11/10* (2013.01)

(58) Field of Classification Search
CPC ..... E02F 9/2058; E02F 9/2235; E02F 9/2246; E02F 9/226; E02F 9/2285; E02F 9/24;
(Continued)

(56) References Cited

U.S. PATENT DOCUMENTS 7,552,705 B2 * 6/2009 Serkh ..... B60W 20/10 180/65.21
2008/0217083 A1 * 9/2008 Serkh ..... B60W 10/18 180/165

FOREIGN PATENT DOCUMENTS

CN 1715684 A 1/2006
EP 1881241 A1 1/2008
(Continued)

OTHER PUBLICATIONS

Extended European Search Report dated Oct. 2, 2020, corresponding to European Application No. 18750672.0.
(Continued)

*Primary Examiner* — Tyler J Lee
(74) *Attorney, Agent, or Firm* — Hauptman Ham, LLP

(57) ABSTRACT

A method of controlling a safety apparatus of a construction machine includes: applying a power to the construction machine when a key switch operation of a worker is input; receiving operation signals of the parking switch, the FNR switch, and the pilot cutoff switch; determining whether operation states of the parking switch, the FNR switch, and the pilot cutoff switch satisfy predetermined conditions; and
(Continued)

controlling the construction machine to be available for the start-up when the predetermined conditions are satisfied. The predetermined conditions are that the parking switch is operated to be on so that a parking brake is operated, the FNR switch is operated to select a neutral so that a traveling direction of the construction machine is in a neutral state, and the pilot cutoff switch is operated to be on so that the construction machine is in a pilot cutoff state.

10 Claims, 3 Drawing Sheets

(51) Int. Cl.
*E02F 9/24* (2006.01)
*F02N 11/08* (2006.01)
*F02N 11/10* (2006.01)

(58) Field of Classification Search
CPC ..... F02D 29/04; F02N 11/08; F02N 11/10; F02N 11/101; F15B 20/00; F15B 2211/6355
See application file for complete search history.

(56) References Cited

FOREIGN PATENT DOCUMENTS

| | | | |
|---|---|---|---|
| JP | 08-156715 | A | 6/1996 |
| JP | 2946495 | B2 | 9/1999 |
| JP | 2000-104291 | A | 4/2000 |
| JP | 2005-307491 | A | 11/2005 |
| KR | 10-2003-0004693 | A | 1/2003 |
| KR | 10-0792855 | B1 | 1/2008 |
| KR | 10-2013-0086872 | A | 8/2013 |
| KR | 10-1293314 | B1 | 8/2013 |

OTHER PUBLICATIONS

Korean Office Action issued on Oct. 5, 2020, in connection with the Korean Patent Application No. 10-2019-7023652.
Chinese Office Action dated Jan. 8, 2021, in connection with corresponding Chinese Patent Application No. 201880011250.1.
International Search Report dated Jun. 18, 2018, in connection with International Patent Application No. PCT/KR2018/001843.

* cited by examiner

CONSTRUCTION MACHINE SAFETY APPARATUS AND CONTROLLING METHOD

CROSS-REFERENCE TO RELATED APPLICATION

The present application is a national stage filing under 35 U.S.C § 371 of PCT application number PCT/KR2018/001843 filed on Feb. 12, 2018 which is based upon and claims the benefit of priority to Korean Patent Application No. 10-2017-0018820, filed on Feb. 10, 2017, in the Korean Intellectual Property Office, which is incorporated herein in its entirety by reference.

TECHNICAL FIELD

The present disclosure relates to a construction machine, and more particularly, to a safety apparatus and a controlling method of a construction machine for preventing safety accidents that may occur when a work apparatus suddenly operates without the intention of a worker at the time of starting a wheel type construction machine.

DISCUSSION OF RELATED ART

A construction machine, such as an excavator, is an apparatus equipped with a work apparatus and capable of performing works, such as an excavation work, by driving the work apparatus. Such construction machines may be classified according to the type of travel apparatuses for traveling, into, for example, a wheel type construction machine including a wheel as a travel apparatus and a crawler type construction machine including a crawler as a travel apparatus.

A conventional wheel type construction machine includes a parking switch for selecting parking of the construction machine, an FNR switch for selecting a traveling direction of the construction machine among forward F, reverse R and neutral N, and a pilot cutoff switch selected so that work apparatuses may not be driven although an operating device provided in a driver's cab of the construction machine are operated, thus capable of selecting various states of the construction machine as the intention of the worker.

Meanwhile, it is preferable that the construction machine is configured such the start-up of the construction machine is possible in a non-driving state, so as to prevent safety accidents that may occur at the time of start-up. However, such functions of preventing safety accidents have been insufficient in conventional construction machines. In particular, in the case of wheel type construction machines, traveling and working of the construction machine should be considered together at the time of start-up, and hence it is more difficult to prevent safety accidents.

SUMMARY

Embodiments of the present invention may be directed to a safety apparatus and a controlling method of a construction machine for preventing safety accidents that may occur at the time of start-up.

TECHNICAL SOLUTION TO THE PROBLEM

According to an embodiment, a safety apparatus of a construction machine includes: a key switch for outputting an operation signal of a driver to apply a power to drive the construction machine; a parking brake switch for outputting an operation signal of the driver regarding whether to operate a parking brake of the construction machine; an FNR switch for outputting an operation signal of the driver to select a traveling direction of the construction machine among a forward direction, a backward direction, and a neutral; a pilot cutoff switch for outputting an operation signal of the driver to select whether or not a work apparatus provided at the construction machine is available for being driven; and a vehicle controller receiving the operation signals input thereto from the parking switch, the FNR switch, and the pilot cutoff switch, and controlling a start-up of an engine according to the operation signals input thereto. The vehicle controller allows the engine to be started when the key switch is operated to apply the power to the construction machine, the parking switch is operated to be on so that the parking brake is in a parking state, the FNR switch is operated so that the neutral is selected, and an off operation of the pilot cutoff switch to stop driving of the work apparatus is identified.

The parking brake switch, the FNR switch and the pilot cutoff switch may be connected to the vehicle controller in parallel with each other, so that each of the operation signals of the parking brake switch, the FNR switch and the pilot cutoff switch may be input to the vehicle controller.

The safety apparatus may further include: a pilot cutoff valve which is switchable to selectively open and close a pilot line of the construction machine; a pilot cutoff relay provided at a power supply line connected to the pilot cutoff switch to apply a power to the pilot cutoff valve; and a work/travel selection switch for outputting an operation signal of the driver to select a drive mode of the construction machine between a travel mode and a work mode. The pilot cutoff relay may include a contact terminal connected to the pilot cutoff switch and a signal terminal connected to the work/travel selection switch, the contact terminal may be switched by a contact switch which is switched corresponding to a signal input to the signal terminal, and when a work mode selection signal is input to the signal terminal from the work/travel selection switch, the pilot cutoff valve may be switched to open the pilot line by the power which is applied as the contact switch is switched.

The pilot cutoff switch may be connected to a safety lever and a control stand rotatably provided at a driver's seat of the construction machine, and the safety lever and the control stand may be electrically connected in series to each other so that a power is not applied to the contact terminal of the pilot cutoff relay when any one of the safety lever and the control stand is operated to be in an on state.

The parking switch and the work/travel selection switch may be connected in series with the signal terminal, and when the parking switch is operated to be on, power application to the signal terminal may be cut off and thus the pilot cutoff valve is switched to block the pilot line.

The safety apparatus may further include: a pilot cutoff relay connected to a signal output terminal of the pilot cutoff switch; and a work/travel selection switch for outputting an operation signal of the driver to select a drive mode of the construction machine between a travel mode and a work mode. The pilot cutoff relay may include a contact terminal connected to the pilot cutoff switch and a signal terminal connected to the work/travel selection switch, the contact terminal may be switched by a contact switch which is switched corresponding to a signal input to the signal terminal, and when a work mode selection signal is input to the signal terminal from the work/travel selection switch, the contact switch may be switched to output a pilot cutoff state release signal.

The parking switch and the work/travel selection switch may be connected in series with the signal terminal, and when the parking switch is operated to be on, power application to the signal terminal may be cut off, thereby blocking a signal from the contact terminal.

According to an embodiment, a method of controlling start-up of a safety apparatus of a construction machine that includes a key switch, a parking switch, an FNR switch, a pilot cutoff solenoid valve, a pilot cutoff switch and a vehicle controller, the method including: applying a power to the construction machine when a key switch operation of a worker is input; receiving operation signals of the parking switch, the FNR switch, and the pilot cutoff switch; determining whether operation states of the parking switch, the FNR switch, and the pilot cutoff switch satisfy predetermined conditions; and controlling the construction machine to be available for the start-up when the predetermined conditions are satisfied. The predetermined conditions are that the parking switch is operated to be on so that a parking brake is operated, the FNR switch is operated to select a neutral so that a traveling direction of the construction machine is in a neutral state, and the pilot cutoff switch is operated to be on so that the construction machine is in a pilot cutoff state.

The safety apparatus of the construction machine may further include: a pilot cutoff valve capable of selectively open and close a pilot line of the construction machine; and a work/travel selection switch for outputting an operation signal for selecting a drive mode of the construction machine between a travel mode and a work mode. When the pilot cutoff switch is operated to be off and the work/travel selection switch may be operated to select the work mode, the pilot cutoff valve is switched to open the pilot line.

When the parking switch is operated to be on, a power applied to the work/travel selection switch may be cut off, and the pilot cutoff valve may be switched to block the pilot line.

EFFECTS OF THE INVENTION

According to the preferred embodiments as described above, it is possible to identify whether or not a pilot cutoff switch, a parking switch, and an FNR switch are operated safely, in a state where a key switch is on and a power is applied to a construction machine. Accordingly, safety accidents that may occur when, for example, a work apparatus or a travel apparatus is suddenly driven without the intention of a worker at the time of starting the construction machine may be substantially prevented.

In addition, when a work/travel selection switch for selecting a work/travel mode of the construction machine, or a parking switch is operated, driving of the work apparatus is stopped (a pilot cutoff state) corresponding thereto, thereby ensuring the prevention of safety accidents and the convenience of the worker.

DETAILED DESCRIPTION

Figure 1:
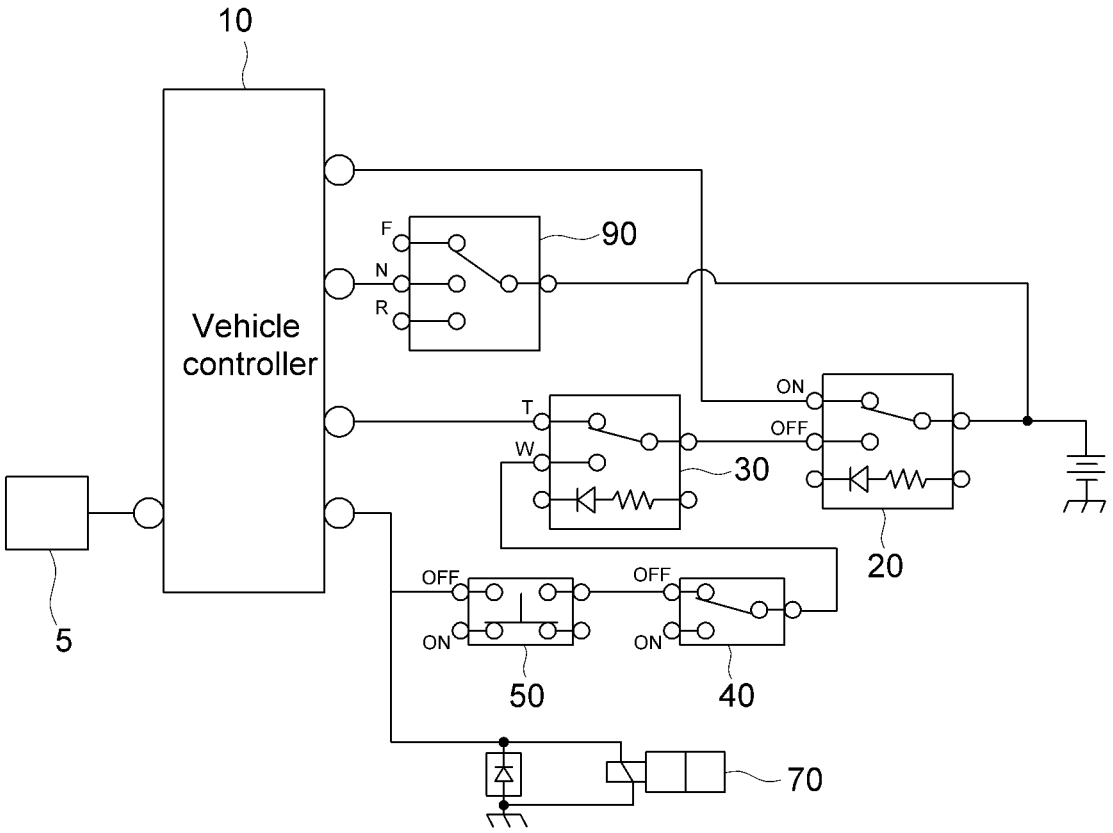
FIG. 1 is a circuit diagram illustrating a start-up condition of a construction machine according to an embodiment.

Hereinafter, embodiments of the present invention will be described in detail with reference to the accompanying drawings.

In describing embodiments, descriptions of techniques which are well known in the technical field to which the present disclosure belongs and which are not directly related to the present disclosure are not described. This is for the sake of clarity without obscuring the gist of the present specification by omitting the unnecessary description.

For the same reason, some of the components in the drawings are exaggerated, omitted, or schematically illustrated. In addition, the size of each component does not entirely reflect the actual size. In the drawings, the same or corresponding components are denoted by the same reference numerals.

Hereinafter, a safety apparatus and a controlling method of a wheel type construction machine for preventing safety accidents that may occur at the time of start-up will be described with reference to the drawings.

FIG. 1 is a circuit diagram illustrating a safety apparatus of a construction machine according to a desired embodiment.

Referring to FIG. 1, a safety apparatus of a construction machine includes a key switch 5, a parking switch 20, an FNR switch 90, pilot cutoff switches 40 and 50, and a vehicle controller 10.

The key switch 5 is a switch operated by a worker to apply a power to the construction machine. When the key switch 5 is operated to be on, the power is applied to the vehicle controller 10 and other electric components, and the start-up of the construction machine is ready. In the case of a construction machine in which an engine is mounted as a power source, preparation for start-up may mean that a starter motor (not illustrated) is driven at the time of a start-up operation of the worker to prepare an engine for cranking. In the case of an electric construction machine, it may mean to prepare the construction machine into a state where a work apparatus is available to be driven when the worker operates an operating device. The key switch 5 may be configured so that the worker may proceed to the cranking operation for driving the starting motor in addition to the power application. For example, the key switch may be configured to be rotatable in steps, such that a power may be applied to the construction machine at a first step of rotation, and when the key switch is further rotated to the second step, the starter motor is started.

The parking switch 20 is a switch for parking the construction machine. When the parking switch is operated to be on, a parking brake is operated to keep the construction machine in a stopped state. The operation of the parking switch 20 is generally carried out when it is determined that the construction machine will not perform works or traveling.

The FNR switch 90 is a switch for selecting a traveling direction of the construction machine among forward F, neutral N, and reverse R. When the worker does not want the construction machine to travel, the FNR switch 90 may be operated to select the neutral N. The vehicle controller 10, to be described below, is connected to all three output terminals of the FNR switch 90 so that a signal may be applied to the vehicle controller 10 regardless of which one of the forward F, the neutral N, and the reverse R is selected by the worker. Alternatively, the vehicle controller 10 may be configured not to be connected to one of the three output terminals of the FNR switch 90, so that when no selection signal is input from the other two of the three output terminals, it may be determined that said one of the three output terminals that is not connected to the vehicle controller 10 is selected. In addition, the vehicle controller 10 may be configured to be connected to a neutral N operation signal output terminal of the FNR switch 90, so that when the neutral N is selected by the worker, the vehicle controller 10 may recognize it.

The work/travel selection switch 30 is operated when a mode of the construction machine is selected as a work mode or a travel mode. The work mode may be selected when the construction machine is to drive the work apparatus to proceed the work, and the travel mode may be selected when the construction machine only requires traveling, such as road driving, without driving the work apparatus. The selection of the travel mode is intended to prevent the work apparatus from being driven even if the worker erroneously operates the operating device while the construction machine is traveling. When the travel mode is selected, a pilot cutoff state, to be described below, may be automatically selected to control the construction machine. The work/travel selection switch 30 is generally provided at a wheel type construction machine capable of traveling on the road.

The pilot cutoff switches 40 and 50 are switches that are selectively operated when the worker does not desire to drive the work apparatus. The pilot cutoff switches 40 and 50 are operated when the worker does not intend to drive the work apparatus, for example, the work will not proceed for a predetermined time, e.g., work standby, or the worker leaves a driver's seat for a certain time. When the pilot cutoff switches 40 and 50 are operated to be on, the construction machine recognizes that the worker does not desire to drive the work apparatus, and the work apparatus is not driven although the operating device is operated thereafter. For example, in the case of a hydraulic construction machine, the pilot cutoff switches 40 and 50 may be connected to a pilot cutoff valve 70. The pilot cutoff valve 70 is provided on a pilot line for driving the work apparatus in the hydraulic construction machine and may block the pilot line when the pilot cutoff switches 40 and 50 are operated to be on. If the pilot line is blocked in this way, a working fluid may not be applied to various cylinders and hydraulic motors for driving the work apparatus. On the other hand, an off operation of the pilot cutoff switches 40 and 50 may mean that the worker is ready for the operation of the operating device to drive the work apparatus, and when the pilot cutoff switches 40 and 50 are operated to be off, the pilot cutoff valve 70 may be switched to open the pilot line. In the case of an electric construction machine, the vehicle controller 10 may control not to apply a power or signals to, for example, an electric motor for driving each work apparatus. Such pilot cutoff switches 40 and 50 may be provided in plural, at the driver's seat as in the present embodiment. As an example, the pilot cutoff switches 40 and 50 may be configured to operate in conjunction with a safety lever and a control stand that are provided to be rotatable at the driver's seat, and when the safety lever or the control stand is rotated, the pilot cutoff switches 40 and 50 are switched. In such a case, the safety lever 40 may be provided so as to be rotatable at a side surface of the driver's seat and may serve the function of one pilot cutoff switch 40 when rotated. The control stand includes two control stands provided at left and right side surfaces of the driver's seat, and may perform the function of the other pilot cutoff switch 50 when one of the two control stands rotatably provided on the side of the driver's entrance is rotated. In general, a work lever and various function selection buttons for a driving operation of the work apparatus are provided at the control stand. The pilot cutoff switch 50 working in conjunction with the control stand may be configured to be off when the worker leaves the driver's seat or when the control stand is rotated upward, and to be always operated when the worker sits in or leaves the driver's seat. In addition, the safety lever may be further provided at one side of the control stand. Besides the aforementioned examples, the pilot cutoff switch may be configured in various forms to identify whether the worker left the driver's seat. For example, the pilot cutoff switch may be configured in the form of a pressure switch provided on a floor of the driver's seat, or in the form to determine whether to perform pilot cutoff through image analysis using a camera monitoring the driver's seat.

Such pilot cutoff switches 40 and 50, dissimilar to other switches, may be connected to the vehicle controller 10. The pilot cutoff switches 40 and 50 may be provided in plural as in the present embodiment descried above. The two pilot cutoff switches 40 and 50 may be connected in series with the vehicle controller 10 such that the vehicle controller 10 may recognize operation of the pilot cutoff switch although one of the two pilot cutoff switches 40 and 50 is off. In the present embodiment illustrated in FIG. 1, since the pilot cutoff valve 70 is provided, when one of the pilot cutoff switches 40 and 50 is operated to be off, an operational power is not applied to the pilot cutoff valve, which can be open and closed electrically, and thus a signal for selecting the pilot cutoff state may be input to the vehicle controller 10. FIG. 1 shows an example in which a vehicle controller and a circuit are configured to determine that the pilot cutoff state is selected when no signal is input to an input terminal of the vehicle controller that is connected to the pilot cutoff switch.

In addition, the pilot cutoff switches 40 and 50 may be connected to the work/travel selection switch 30, the parking switch 20, and the vehicle controller 10 such that the construction machine may enter the pilot cutoff state even if the pilot cutoff switches 40 and 50 are not operated during the operation of the parking switch 20 or the work/travel selection switch 30. To this end, an input terminal of the pilot cutoff switches 40 and 50 may be connected to a work mode selection signal output terminal of output terminals of the work/travel selection switch 30. In addition, an input terminal of the work/travel selection switch 30 may be connected to an off selection output terminal (for outputting a parking brake operation release signal) of the parking switch 20. Accordingly, the vehicle controller 10 may recognize that the pilot cutoff state of the construction machine is selected irrespective of the operation state of the pilot cutoff switch when the parking brake is in operation or the construction machine is in the travel mode. In addition, in the case of the hydraulic construction machine in which the pilot cutoff state is performed by the pilot cutoff valve 70 as in the present embodiment, when the parking brake is in operation or the construction machine is in the travel mode, the pilot cutoff valve 70 may be switched to a position for blocking the pilot line. The pilot cutoff valve 70 illustrated in FIG. 1 shows an example in which a power applied to the pilot cutoff valve 70 is cut off and the pilot line is blocked.

The vehicle controller 10 receives selection operation signals corresponding to selection operations of the aforementioned switches 5, 20, 30, 40, 50 and 90 to determine whether or not the construction machine is in a state capable of being started. Referring to FIG. 1, the vehicle controller 10 is electrically connected to the key switch 5, the parking switch 20, the FNR switch 90, the work/travel selection switch 30 and the pilot cutoff switches 40 and 50, and thus it is possible to input the selection operation signals respectively output from the switches. In such an embodiment, the vehicle controller 10 may be configured to recognize that the key switch 5 is on when a power is applied to the vehicle controller 10, although the vehicle controller 10 is not separately connected to the key switch 5.

A method of controlling the above-described safety apparatus according to an embodiment will now be described. First, when the key switch 5 is operated to be on to apply a power, the vehicle controller 10 waits for an input of a selection signal based on operations of the parking switch 20, the FNR switch 90, the work/travel selection switch 30 and the pilot cutoff switches 40 and 50. When the parking switch 20 is operated to be on by the worker, the FNR switch 90 is operated to be the neutral N, and the pilot cutoff switches 40 and 50 are operated to be on, the vehicle controller 10 determines that it is a state where the construction machine is available for start-up based on the signals input through the input terminals, and is on standby. In such a case, when a start-up operation of the worker proceeds, the vehicle controller 10 controls the engine so that the construction machine is started. On the other hand, when the parking switch 20 is operated to release the parking brake, or the FNR switch 90 is not selected to the neutral N position, it is determined that the construction machine is not ready to be started, and the construction machine is controlled not to be started although the worker performs the start-up operation. The start-up control of the construction machine may be carried out in various ways. In the present embodiment, a starter relay is controlled to prevent the engine from starting. In such an embodiment, the starter relay may be selected in any structure according to circumstances, such as digital work output (DHO) or digital low output (DLO) among the terminals.

Figure 2:
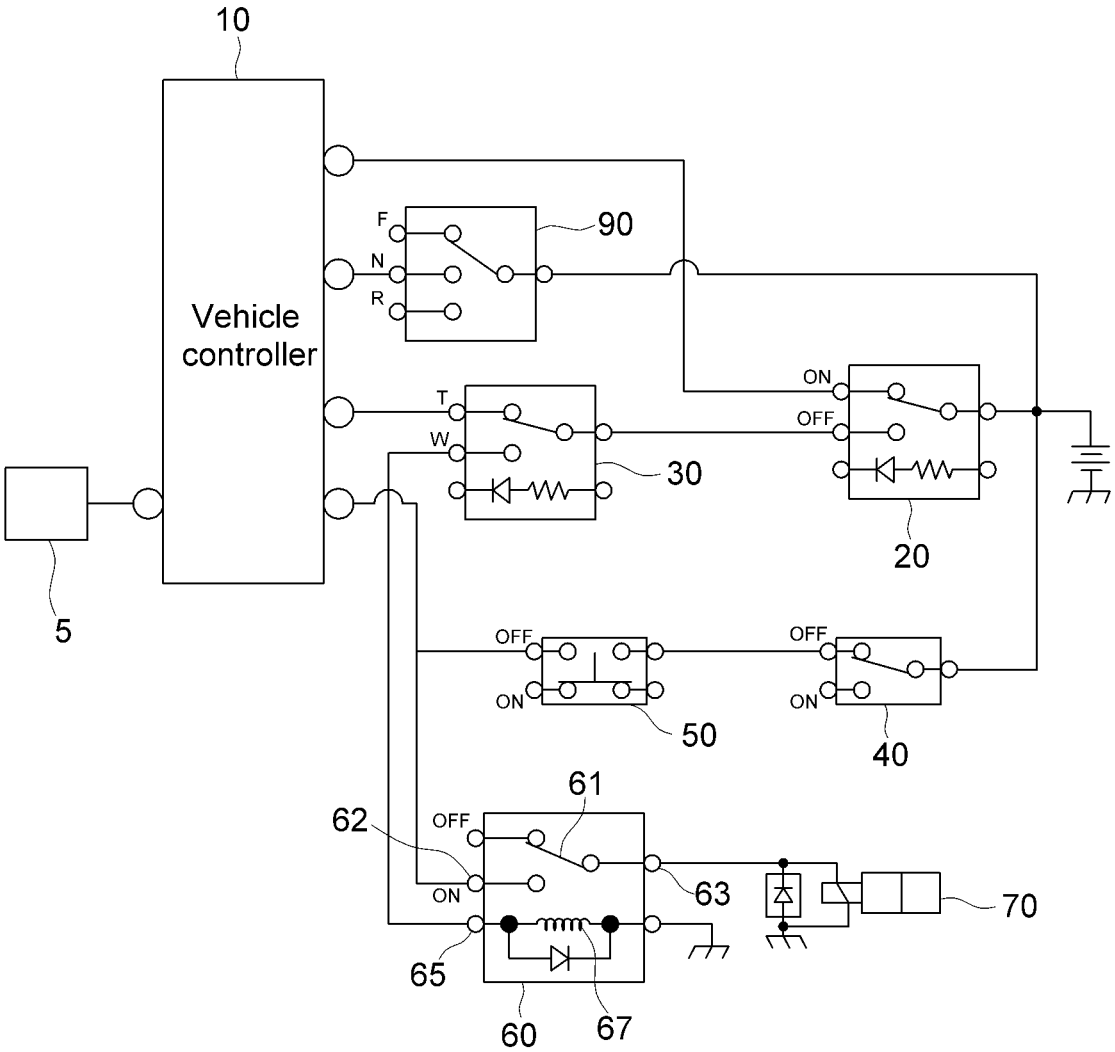
FIG. 2 is a circuit diagram illustrating a safety apparatus of a construction machine according to another embodiment.

A safety apparatus of a construction machine according to an embodiment illustrated in FIG. 2 includes a key switch 5, a parking switch 20, an FNR switch 90, pilot cutoff switches 40 and 50, a pilot cutoff relay 60 and a vehicle controller 10. In the present embodiment, the pilot cutoff relay 60 is added, and the electric connection structure with the vehicle controller is configured differently from the embodiment of FIG. 1.

The pilot cutoff switches 40 and 50, dissimilar to those of the embodiment illustrated in FIG. 1, are connected to an input terminal of the vehicle controller 10 independently of the parking switch 20 and a work/travel selection switch 30. That is, the parking switch 20, the work/travel selection switch 30, and the pilot cutoff switches 40 and 50 are each connected to the vehicle controller 10 in parallel. According to this, a signal according to the operation of the pilot cutoff switches 40 and 50 is capable of being input to the vehicle controller 10 only when the pilot cutoff switches 40 and 50 are operated. In a case where two pilot cutoff switches are provided as in the present embodiment, when one of the two pilot cutoff switches is operated, the vehicle controller 10 is capable of recognizing the operation state of the pilot cutoff switches 40 and 50. In the foregoing embodiment, when the parking switch 20 is operated to be on, or when the work/travel selection switch 30 is operated to select the travel mode T, a signal power applied to the pilot cutoff switches 40 and 50 is cut off, so it is difficult for the vehicle controller 10 to recognize which state the pilot cutoff switches 40 and 50 are in. However, according to the present embodiment, the vehicle controller 10 may identify the operation state of the pilot cutoff switches 40 and 50 independently of the operation of the parking switch 20 and the work/travel selection switch 30. Accordingly, it is possible to prevent the work apparatus from suddenly operating when the construction machine is switched to the work mode or the parking brake is released in a state where the pilot cutoff switches 40 and 50 are off.

The pilot cutoff relay 60 includes a contact terminal 62, a signal terminal 65 and a contact switch 61. The contact terminal 62 is connected to an output terminal of the pilot cutoff switch 40 and 50. When the pilot cutoff switches 40 and 50 are operated to be off, a power may be applied from the battery to the contact terminal 62 through the pilot cutoff switches 40 and 50. The signal terminal 65 is connected to the work mode W selection output terminal among output terminals of the work/travel selection switch 30. The work/travel selection switch 30 is also connected in series with an output terminal of the parking switch 20. In such a case, when the parking switch 20 is operated to be off so that the operation of the parking brake is released, and the work/travel selection switch 30 is operated to select the work mode W, a work mode selection signal may be applied to the signal terminal 65 to serve as a signal power. When the power is applied to the signal terminal 65, the contact switch 61 is switched such that the power applied to the switch terminal 62 is applied to the pilot cutoff valve 70 as a driving power. The contact switch 61 may be switched by an electromagnetic signal when an electromagnet 67 driven by the signal power is in an on state. In the case of an electric construction machine that does not use a hydraulic pressure, the construction machine may be switched into the pilot cutoff state by applying a signal to the vehicle controller 10 when the contact switch 61 is switched. This pilot cutoff relay 60 allows the pilot cutoff switches 40 and 50 to output an operation signal of the worker to the vehicle controller 10, independently of the parking switch 20 and the work/travel selection switch 30. In addition, the construction machine may enter the pilot cutoff state, in conjunction with the parking switch 20 and the work/travel selection switch 30, even when the pilot cutoff switches 40 and 50 are not operated to be on.

Figure 3:
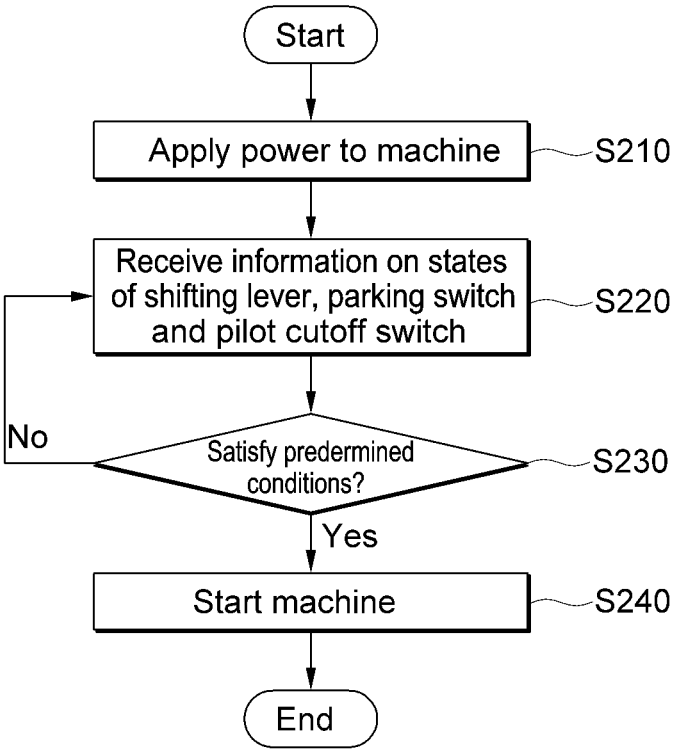
FIG. 3 is a flowchart illustrating a method of controlling the safety apparatus of FIG. 2.

Hereinafter, a method of controlling a safety apparatus of a construction machine according to an embodiment will be described with reference to FIG. 3.

A power is applied to the construction machine by operation of the key switch by the worker (S210).

The vehicle controller 10 receives operation signals from the pilot cutoff switches 40 and 50, the parking switch 20, and the FNR switch, which control the work availability of the construction machine (S220).

The vehicle controller 10 identifies whether the pilot cutoff switches 40 and 50 are operated to be on, the parking switch 20 is operated to be on, and the FNR switch 90 is selected as the neutral N (S230). That is, it is identified whether the predetermined start-up conditions are satisfied to ensure safety. When each of the switches is operated as described above, the vehicle controller 10 determines that the parking brake is in operation, the travel operation is not performed, and the work apparatus is in a stopped state. If the above conditions are satisfied, it means that the start-up of the construction machine may be performed in a safe state, and thus the vehicle controller 10 proceeds to step S240 and controls the construction machine to be in a state available for start-up. When the worker performs a start-up operation in such a state, the start-up is permitted and the start-up of the construction machine may be completed. On the other hand, when only one of conditions of the parking brake is in a non-operation state, the FNR switch is selected as the forward F or the reverse R, and the pilot cutoff switch is in the on state is satisfied, the vehicle controller 10 does not allow the start-up of the construction machine.

In an embodiment, even when the start-up of the construction machine is completed and the construction machine is in operation, the worker may request entry of the pilot cutoff state if the worker does not intend to operate the work apparatus for a certain period of time. This is to prevent the work apparatus from being driven due to erroneous operation of the work apparatus, when the absence of the worker from the driver's seat or the work standby is expected to continue for a predetermined period of time. According to the present embodiment, the pilot cutoff state may start by operating the parking switch 20 to be on, operating the work/travel selection switch 30 to select the travel mode, or operating the pilot cutoff switches 40 and 50 to be on. In this case as well, the vehicle controller 10 may continuously monitor the operation state of the pilot cutoff switches 40 and 50. Accordingly, the work apparatus may be substantially prevented from being suddenly driven when the construction machine enters or releases the pilot cutoff state by operation of the switches other than the pilot cutoff switches 40 and 50. The sudden driving of the work apparatus may occur when the parking switch 20 or the work/travel selection switch 30 is operated to enter the pilot cutoff state and then return to a normal state, in a state that the pilot cutoff switches 40 and 50 are off. It may also occur when the construction machine is started while the operating device is operated although the pilot cutoff switches 40 and 50 are off. However, when the state of the pilot cutoff switches 40 and 50 can be monitored by the vehicle controller 10 at all times, as in the present embodiment, the worker may be notified whether the pilot cutoff switches 40 and 50 are in the off state at the time of the off operation of the parking switch 20 or the selection of the travel mode T of the operation/travel selection switch 30. Such an alarm may be output through an image information on an instrument panel or a warning sound. Alternatively, the vehicle controller 10 may be configured to control the construction machine not to release the pilot cutoff state although the off operation of the parking switch 20 or the selection of the travel mode T is performed in a state that the pilot cutoff switches 40 and 50 are off. Such a safety function may effectively prevent safety accidents in cases where the operation device is operated regardless of the worker's intention at the time of releasing the pilot cutoff state.

The foregoing description is merely illustrative of the present invention, and various modifications may be made by those skilled in the art without departing from the spirit of the present invention. Accordingly, the embodiments disclosed in the specification of the present invention are not intended to limit the present invention. The scope of the present invention should be construed according to the following claims, and all the techniques within the scope of equivalents should be construed as being included in the scope of the present invention.

INDUSTRIAL APPLICABILITY

The invention disclosed herein is industrially applicable since it can promote sales of the construction machine applied with the relevant technology and it is clearly described to be practically possible to carry out, with the effects of effectively preventing safety accidents at the time of start-up through the methods of identifying the safe state to allow the start-up based on operation signals output from a key switch, an FNR switch and a pilot cutoff switch.

The invention claimed is:

1. A safety apparatus of a construction machine, the safety apparatus comprising:

a key switch for outputting an operation signal of a driver to apply a power to drive the construction machine;

a parking brake switch for outputting an operation signal of the driver regarding whether to operate a parking brake of the construction machine;

an FNR switch for outputting an operation signal of the driver to select a traveling direction of the construction machine among a forward direction, a backward direction, and a neutral;

a pilot cutoff switch for outputting an operation signal of the driver to select whether or not a work apparatus provided at the construction machine is available for being driven; and a vehicle controller receiving the operation signals input thereto from the parking switch, the FNR switch, and the pilot cutoff switch, and controlling a start-up of an engine according to the operation signals input thereto, wherein the vehicle controller allows the engine to be started when the key switch is operated to apply the power to the construction machine, the parking switch is operated to be on so that the parking brake is in a parking state, the FNR switch is operated so that the neutral is selected, and an off operation of the pilot cutoff switch to stop driving of the work apparatus is identified.

2. The safety apparatus of the construction machine of claim 1, wherein the parking brake switch, the FNR switch and the pilot cutoff switch are connected to the vehicle controller in parallel with each other, so that each of the operation signals of the parking brake switch, the FNR switch and the pilot cutoff switch is input to the vehicle controller.

3. The safety apparatus of the construction machine of claim 2, further comprising:

a pilot cutoff valve which is switchable to selectively open and close a pilot line of the construction machine;

a pilot cutoff relay provided at a power supply line connected to the pilot cutoff switch to apply a power to the pilot cutoff valve; and a work/travel selection switch for outputting an operation signal of the driver to select a drive mode of the construction machine between a travel mode and a work mode, wherein the pilot cutoff relay comprises a contact terminal connected to the pilot cutoff switch and a signal terminal connected to the work/travel selection switch, the contact terminal is switched by a contact switch which is switched corresponding to a signal input to the signal terminal, and when a work mode selection signal is input to the signal terminal from the work/travel selection switch, the pilot cutoff valve is switched to open the pilot line by the power which is applied as the contact switch is switched.

4. The safety apparatus of the construction machine of claim 3, wherein the pilot cutoff switch is connected to a safety lever and a control stand rotatably provided at a driver's seat of the construction machine, and the safety lever and the control stand are electrically connected in series to each other so that a power is not applied to the contact terminal of the pilot cutoff relay when any one of the safety lever and the control stand is operated to be in an on state.

5. The safety apparatus of the construction machine of claim 3, wherein the parking switch and the work/travel selection switch are connected in series with the signal terminal, and when the parking switch is operated to be on, power application to the signal terminal is cut off and thus the pilot cutoff valve is switched to block the pilot line.

6. The safety apparatus of the construction machine of claim 2, further comprising:

a pilot cutoff relay connected to a signal output terminal of the pilot cutoff switch; and a work/travel selection switch for outputting an operation signal of the driver to select a drive mode of the construction machine between a travel mode and a work mode, wherein the pilot cutoff relay comprises a contact terminal connected to the pilot cutoff switch and a signal terminal connected to the work/travel selection switch, the contact terminal is switched by a contact switch which is switched corresponding to a signal input to the signal terminal, and when a work mode selection signal is input to the signal terminal from the work/travel selection switch, the contact switch is switched to output a pilot cutoff state release signal.

7. The safety apparatus of the construction machine of claim 6, wherein the parking switch and the work/travel selection switch are connected in series with the signal terminal, and when the parking switch is operated to be on, power application to the signal terminal is cut off, thereby blocking a signal from the contact terminal.

8. A method of controlling start-up of a safety apparatus of a construction machine that comprises a key switch, a parking switch, an FNR switch, a pilot cutoff solenoid valve, a pilot cutoff switch, and a vehicle controller, the method comprising:

applying a power to the construction machine when a key switch operation of a worker is input;

receiving operation signals of the parking switch, the FNR switch, and the pilot cutoff switch;

determining whether operation states of the parking switch, the FNR switch, and the pilot cutoff switch satisfy predetermined conditions; and controlling the construction machine to be available for the start-up when the predetermined conditions are satisfied, wherein the predetermined conditions are that the parking switch is operated to be on so that a parking brake is operated, the FNR switch is operated to select a neutral so that a traveling direction of the construction machine is in a neutral state, and the pilot cutoff switch is operated to be on so that the construction machine is in a pilot cutoff state.

9. The method of claim 8, wherein the safety apparatus of the construction machine further comprises:

a pilot cutoff valve capable of selectively open and close a pilot line of the construction machine; and a work/travel selection switch for outputting an operation signal for selecting a drive mode of the construction machine between a travel mode and a work mode, wherein when the pilot cutoff switch is operated to be off and the work/travel selection switch is operated to select the work mode, the pilot cutoff valve is switched to open the pilot line.

10. The method of claim 9, wherein when the parking switch is operated to be on, a power applied to the work/travel selection switch is cut off, and the pilot cutoff valve is switched to block the pilot line.

* * * * *